US006681937B2

(12) United States Patent
Yamoto et al.

(10) Patent No.: US 6,681,937 B2
(45) Date of Patent: Jan. 27, 2004

(54) PACKING TAPE COMPOSITION AND PACKING METHOD USING THE PACKING TAPE COMPOSITION

(75) Inventors: Tadashi Yamoto, Tokyo (JP); Hiroyuki Takehana, Tokyo (JP)

(73) Assignee: SMK Corporation, Tokyo (JP)

( * ) Notice: Subject to any disclaimer, the term of this patent is extended or adjusted under 35 U.S.C. 154(b) by 183 days.

(21) Appl. No.: 10/092,763

(22) Filed: Mar. 7, 2002

(65) Prior Publication Data

US 2002/0185408 A1 Dec. 12, 2002

(30) Foreign Application Priority Data

Jun. 8, 2001 (JP) ..... 2001-173766

(51) Int. Cl.[7] ..... B65D 73/02

(52) U.S. Cl. ..... 206/713; 206/820; 206/716; 206/467

(58) Field of Search ..... 206/713, 714, 206/715, 716, 717, 820, 467, 477, 478, 480

(56) References Cited

U.S. PATENT DOCUMENTS

| | | | | |
|---|---|---|---|---|
| 5,064,064 A | * | 11/1991 | Itou et al. | 206/714 |
| 5,085,362 A | * | 2/1992 | Art et al. | 228/49.1 |
| 5,203,143 A | * | 4/1993 | Gutentag | 53/452 |
| 5,360,110 A | | 11/1994 | Hirai et al. | 206/330 |
| 6,016,918 A | * | 1/2000 | Ziberna | 206/714 |

FOREIGN PATENT DOCUMENTS

| | | | |
|---|---|---|---|
| GB | 2083001 A | 3/1982 | B65D/73/02 |

* cited by examiner

*Primary Examiner*—Jila M. Mohandesi
(74) *Attorney, Agent, or Firm*—Darby & Darby

(57) ABSTRACT

Receiving pockets are formed by folding open-top box-like structures from paper. The structures are affixed in registration with holes in a tape substrate to receive objects to be packed therein. After the objects are packed, a covering tape is added to secure the packed objects in their respective receiving pockets. The receiving pockets, tape substrate and covering tape are all preferably of paper to permit environmentally friendly disposal after use by incineration or other disposal.

3 Claims, 6 Drawing Sheets

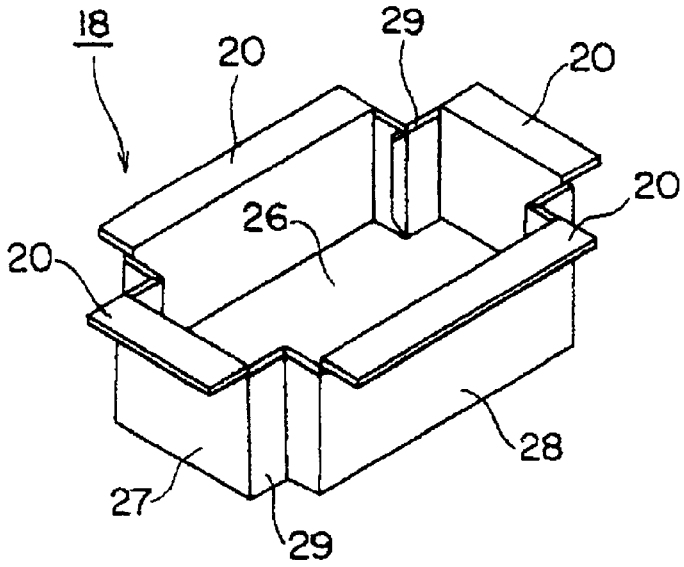
Fig. 6
Fig. 7
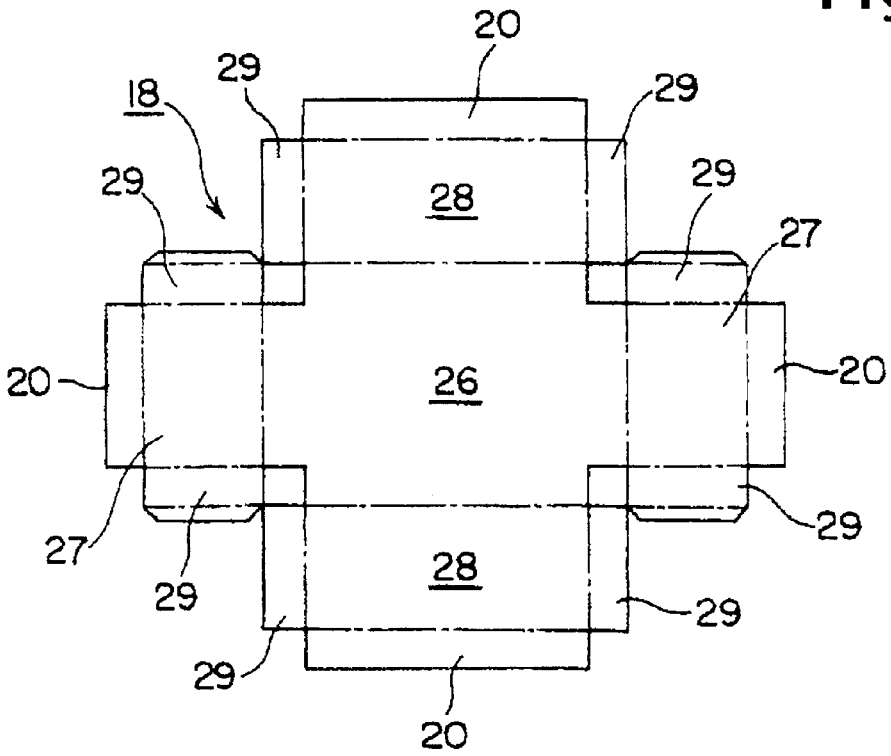

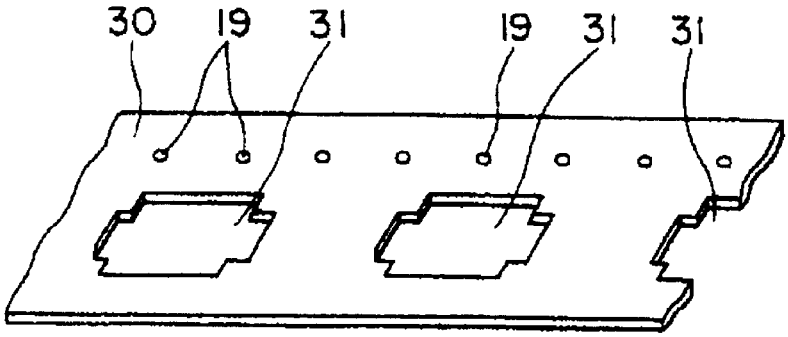
Fig. 8
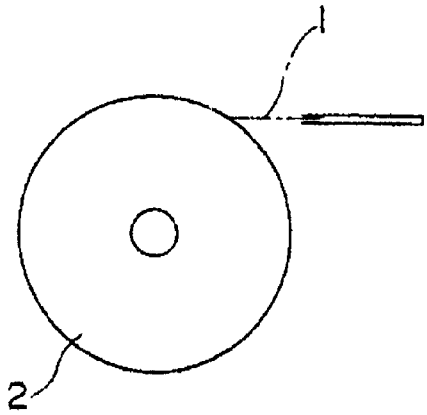
Fig. 9
PRIOR ART
Fig. 10
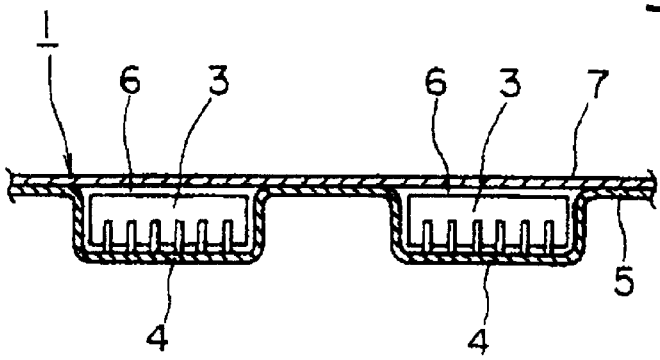
PRIOR ART

PACKING TAPE COMPOSITION AND PACKING METHOD USING THE PACKING TAPE COMPOSITION

BACKGROUND OF THE INVENTION

1. Field of the Invention

The present invention relates to a packing tape composition for packing an electronic component such as LSI in the form of a reel and a packing method using the packing tape composition.

2. Description of the Related Art

Referring to FIG. 9, generally, a packing method is known for packing an electronic component, such as LSI. The electronic component is received in a packing tape composition 1 known as an embossed carrier tape. The packed components are rolled on a reel 2. Recently, electronic components are automatically mounted on circuit boards. The packing method of FIG. 9 is currently used since it is adapted easily to automatic machines.

As shown in FIG. 10, the conventional packing tape composition 1 is composed of a tape substrate 5 having receiving recesses 4 for receiving objects 3 to be packed such as electronic components at constant intervals. A covering tape 7 is superposed on the tape substrate 5 to close openings 6 of the receiving recesses 4. The receiving recesses 4 are formed by embossing (or extruding) the tape substrate 5 of a plastic such as polyvinyl chloride.

In packing, the covering tape 7, made of plastic like the tape substrate 5, is superposed on the tape substrate 5 so that the object 3 such as electronic component is received in the receiving recess 4. Then the contacting edges of the tape substrate 5 and the covering tape 7 are fused to retain the object in the packing tape composition 1.

However, after the electronic components received in the packing tape compositions are mounted (or used), the packing tape compositions are no longer useful, and are incinerated or disposed as waste. Such waste disposal raises problems since the plastic material, generally polypropylene or polyethylene, is not easily incinerated because of the environmental problems arising from harmful substances generated during incineration. In the absence of incineration, landfill disposal requires substantial land volume, which may not always be available.

Referring to FIG. 11, a packing tape composition 11 is known as one solution of these problems. An exposed hole 9 is perforated in a tape substrate 8 made of less harmful material, such as paper. The electronic component 3 is mounted in the exposed hole 9. The body of the electronic component 3 is glued and held on a tacking tape 10 exposed through the exposed hole 9. Then the tape substrate 8, carrying the electronic components 3 is rolled on a reel. However, this packing tape composition 11 has a drawback that it is suitable only for a limited number of types of objects (or electronic components) 3. If the objects 3 have profiles that are too dissimilar from the embossed carrier tape 1, then this method cannot be used.

OBJECTS AND SUMMARY OF THE INVENTION

In view of such prior art problems, an object of the present invention is to provide an environmentally friendly packing tape composition available for any profile of an object to be packed and a packing method using the packing tape composition.

To solve the aforementioned prior art problems to achieve the intended purpose, a feature of a packing tape composition according to the present invention is that in the packing tape composition comprising a tape substrate having receiving recesses for receiving objects at constant intervals and a covering tape superposed on the tape substrate to close openings of the receiving recesses, both of the tape substrate and the covering tape are formed of paper. Receiving pockets, each formed like a box with an open side by folding a paper sheet, are fixed to the tape substrate to form the receiving recesses such that insertion holes perforated in the tape substrate at constant intervals are communicated with respective openings of the receiving pockets.

Preferably, adhesion strips are provided at a periphery of the opening of the receiving pocket.

Also, the feature of the packing method using the packing tape composition according to the present invention comprises the steps of: fixing receiving pockets, each formed like a box with an open side by folding a paper sheet, to a tape substrate to form receiving recesses such that insertion holes perforated in the tape substrate made of paper at constant intervals are communicated with the openings of the receiving pockets; receiving objects in the receiving recesses; and superposing a covering tape made of paper on the tape substrate to close the openings.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 6 is a perspective view of a receiving pocket according to another embodiment of the present invention.

FIG. 7 is an unfolded view of the receiving pocket of the packing tape composition of FIG. 6.

FIG. 8 is a perspective view of a tape substrate according to another embodiment.

FIG. 9 is a side view illustrating packing operation using a conventional packing tape composition.

FIG. 10 is a longitudinal sectional view illustrating the conventional packing tape composition.

DETAILED DESCRIPTION OF THE PREFERRED EMBODIMENTS

Figure 1:
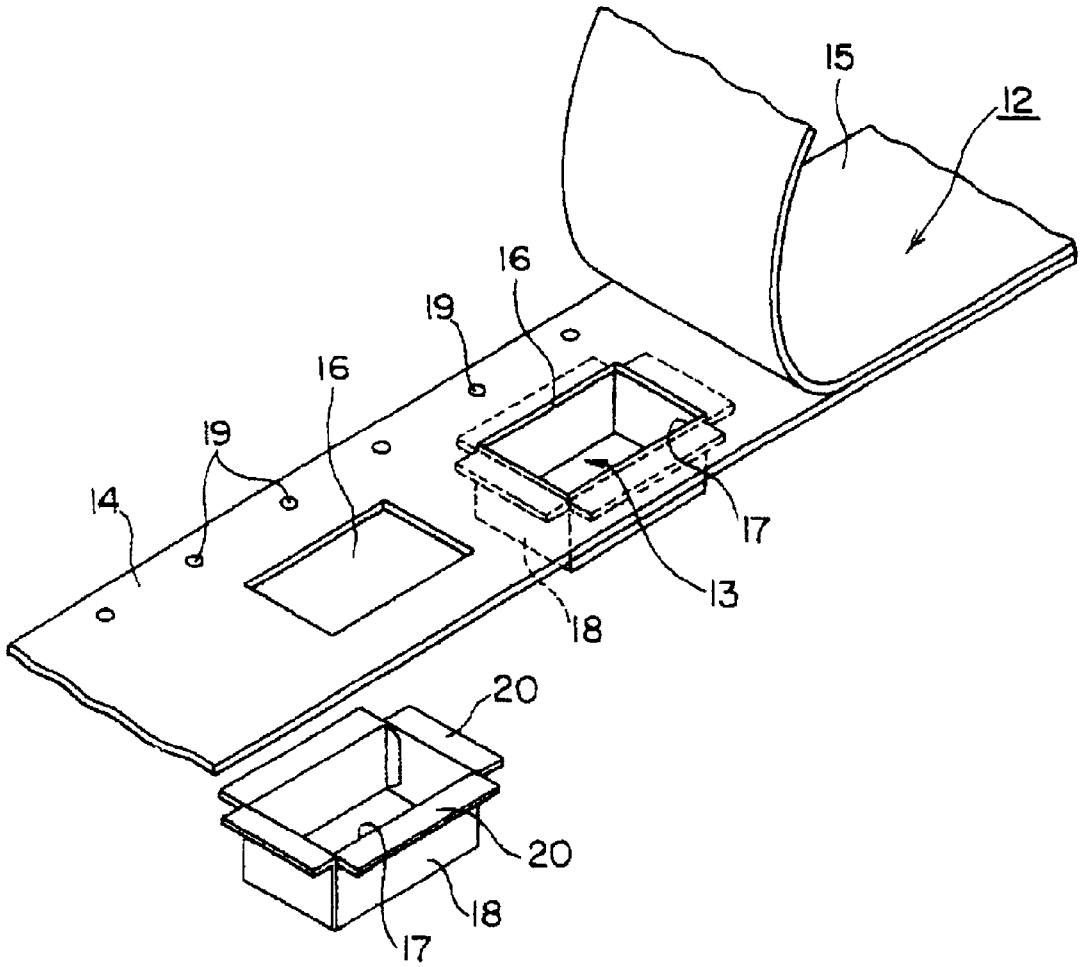
FIG. 1 is an exploded perspective view illustrating an embodiment of a packing tape composition according to the present invention.

Referring to FIG. 1, a packing tape composition 12 is composed of a tape substrate 14 having insertion holes 16 uniformly spaced along its length. Alignment holes 19 are punched through the tape substrate 14 at regular intervals to enable machine handling. Affixed below each insertion hole 16 is a receiving recess 13 which is in registration with its respective insertion hole 16.

Figure 2:
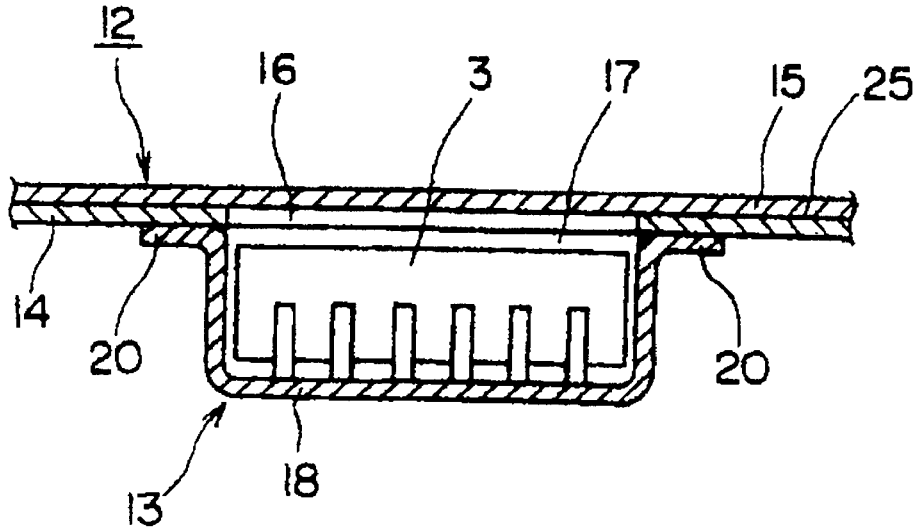
FIG. 2 is a longitudinal sectional view of the packing tape composition of FIG. 1 in assembled condition.

Referring momentarily to FIG. 2, an electronic component 3 such as, for example, an LSI, is deposited in each receiving recess 13.

Returning now to FIG. 1, after the receiving recesses 13 receive their electronic component 3, a covering tape 15 is affixed over the surface to retain the electronic components 3 in place.

Figure 3:
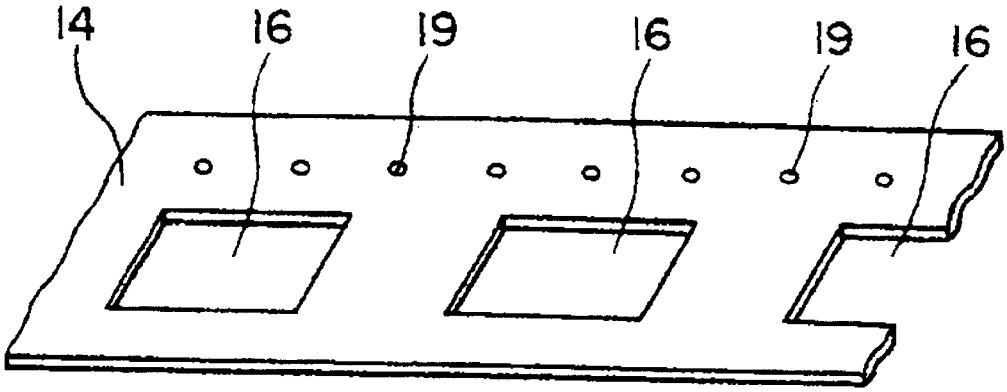
FIG. 3 is a perspective view illustrating a tape substrate of the packing tape composition of FIG. 1.

Referring to FIG. 3, the tape substrate 14, preferably a tape of paper, has perforated therein at regular intervals insertion holes 16 configured to fit to the profile of the electronic component 3 to be packed.

Figure 4:
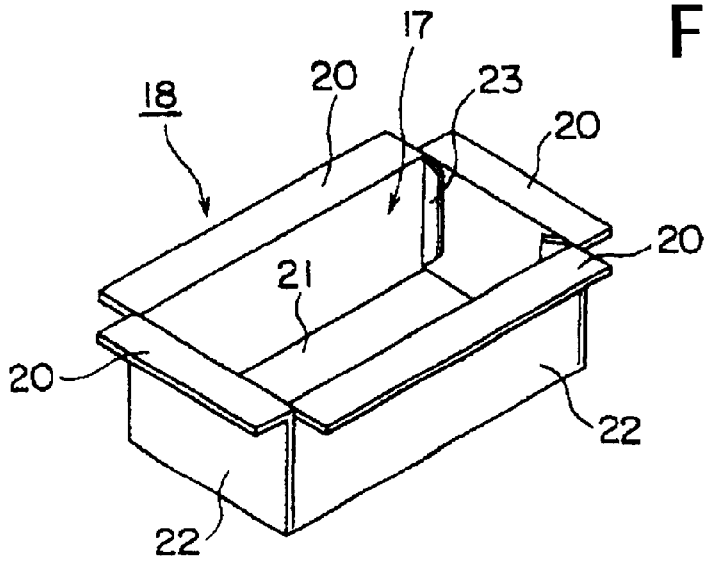
FIG. 4 is a perspective view illustrating a receiving pocket of the packing tape composition of FIG. 1.

Referring now to FIG. 4, the receiving recesses 13 are formed by receiving pockets 18, also preferably of folded paper. The receiving pocket 18 is formed like a box with an open top, as shown in FIG. 4. The profile of the receiving pocket is configured to fit the profile of the object (or electronic component) 3 to be packed therein. Adhesion strips 20 are provided about the periphery of the opening 17 of the receiving pocket 18. The strips 20 are fixed to the tape substrate 14 with an adhesive such that the receiving pocket 18 is fixed to the tape substrate 14.

Figure 5:
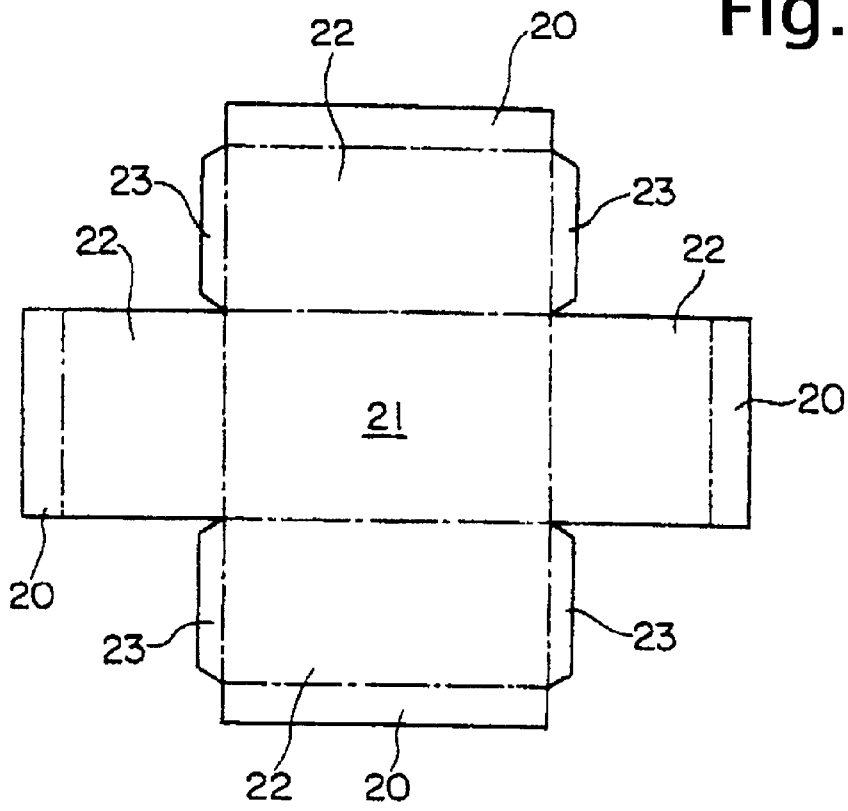
FIG. 5 is an unfolded view of the receiving pocket of the packing tape composition of FIG. 1.
Figure 11:
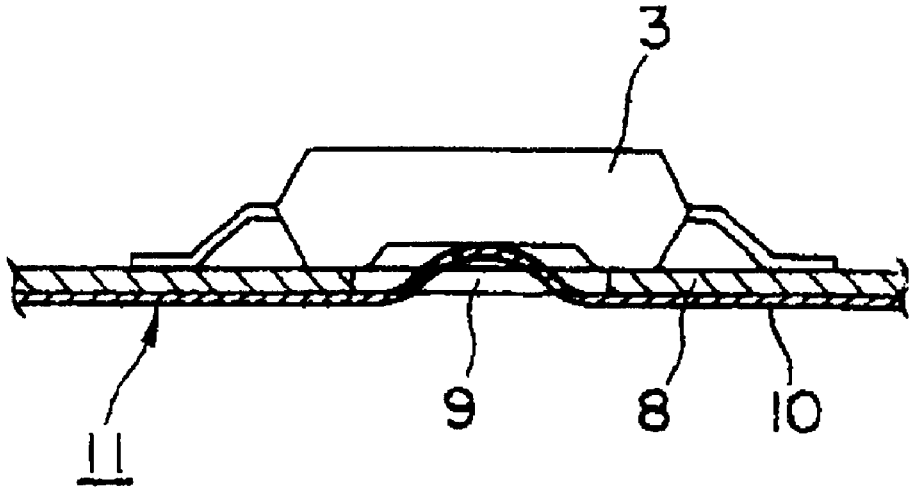
Fig. 11 PRIOR ART
FIG. 11 is a longitudinal sectional view illustrating another example of the conventional packing tape composition.

Referring now to FIG. 5, the receiving pocket 18 is formed by punching a paper sheet in an unfolded condition, folding the punched sheet along the shown alternate long and short dash lines, and assembling the folded sheet. A bottom plate 21 forms the bottom of the receiving pocket 18. Side plates 22 form a peripheral wall. Connecting adhesion strips 23 connect the edges of adjacent side plates 22.

The covering tape 15 is preferably a paper tape.

Next, a packing method using the described packing tape composition 12 will be described.

First, each component of the tape substrate 14 and the receiving pocket (in unfolded condition) 18 is formed by pressing (or punching) paper. The receiving pocket (in unfolded condition) 18 is folded to form a box shape with an open top.

Then, the receiving pocket 18 is fixed with the insertion hole 16 in registration with the opening 17 of the receiving pocket 18. Thereby the receiving recesses 13 are formed at regular intervals.

After the electronic component 3 or the object to be packed has been inserted into the receiving recess 13, an adhesive 25 is applied to the surface of one or both of the covering tape 15 and the tape substrate 14. Then the covering tape 15 is affixed to the surface of the tape substrate 14.

The packed components are rolled on a reel sequentially, whereby the packing operation is completed.

Referring now to FIGS. 6 and 7, while the above embodiment has described an example in which receiving pocket 18 is formed as a rectangular parallelepiped box, the pocket can be configured to fit the profile of the electronic component (or object) 3 as desired. For example, a bottom plate 26 can be formed like approximately cross-shape, and side plates 27, 28, and 29 forming the peripheral wall can be formed to correspond to the profile of the bottom plate 26 as shown in FIGS. 6 and 7. In this case, as shown in FIG. 8, an insertion hole 31 perforated in a tape substrate 30 is configured similarly as the opening of the receiving pocket 18 to be fitted to the profile of the electronic component 3.

As described above, the packing tape composition according to the present invention comprises a tape substrate having receiving recesses for receiving objects for packing at constant intervals and a covering tape superposed on said tape substrate to close openings of said receiving recesses. In this construction, both the tape substrate and the covering tape are formed of paper, and receiving pockets, each formed like a box with an open side by folding a paper sheet, are fixed to said tape substrate to form said receiving recesses such that insertion holes perforated in said tape substrate at constant intervals communicate with respective openings of the receiving pockets. Therefore after the objects such as the electronic components are mounted (or used), the packing tape composition does not generate harmful substance or is environmentally friendly even if the composition is incinerated or disposed of as waste, because each component is formed of paper. Furthermore, the composition is available for various objects to be packed, because the receiving pocket can be configured to fit the profile of the objects.

In addition, since the adhesion strips are provided at the periphery of the opening of the receiving pocket, the receiving recess can be formed preferably, and high strength of the receiving recess can be ensured.

The packing method using the packing tape composition according to the present invention comprises the steps of: fixing receiving pockets, each formed like a box with an open side by folding a paper sheet, to a tape substrate to form receiving recesses such that insertion holes perforated in the tape substrate made of paper at constant intervals are communicated with the openings of the receiving pockets; receiving objects in the receiving recesses; and superposing a covering tape made of paper on the tape substrate to close the openings. Therefore, the packing method is environmentally friendly because the packing tape composition does not generate harmful substance even if it is incinerated or disposed as waste after use, and it can be preferably used to pack the various objects depending on their profiles.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A packing tape composition comprising:

a tape substrate;

a plurality of receiving recesses regularly spaced along said tape substrate for receiving objects for packing;

a covering tape superposed on said tape substrate to close openings of said receiving recesses, both of said tape substrate and said covering tape are paper;

receiving pockets, each folded from a paper sheet to form a box with an open side;

said receiving pockets are fixed to said tape substrate to form said receiving recesses such that insertion holes perforated in said tape substrate at constant intervals are in registration with respective openings of said receiving pockets.

2. The packing tape composition according to claim 1, further comprising adhesion strips at a periphery of the opening of said receiving pocket.

3. A packing method using a packing tape composition, the method comprising the steps of:

forming receiving pockets by folding paper sheets into boxes each with an open side;

forming insertion holes at regular intervals in a tape substrate;

affixing said receiving pockets in registration with said insertion holes to form receiving recesses;

inserting objects in said receiving recesses; and superposing a covering tape made of paper on said tape substrate to close said receiving recesses.

* * * * *